US009482425B2

(12) United States Patent
Wang

(10) Patent No.: US 9,482,425 B2
(45) Date of Patent: Nov. 1, 2016

(54) LED LAMP HEAT DISSIPATING STRUCTURE

(71) Applicant: HABEMIT INTERNATIONAL CO. LTD., Zhongli (TW)

(72) Inventor: Chin-Wen Wang, Zhongli (TW)

(73) Assignee: HABEMIT INTERNATIONAL CO. LTD., Taoyuan County (TW)

( * ) Notice: Subject to any disclaimer, the term of this patent is extended or adjusted under 35 U.S.C. 154(b) by 198 days.

(21) Appl. No.: 14/515,543

(22) Filed: Oct. 16, 2014

(65) Prior Publication Data

US 2016/0053983 A1 Feb. 25, 2016

(30) Foreign Application Priority Data

Aug. 22, 2014 (TW) ..... 103128899 A

(51) Int. Cl.

| | |
|---|---|
| ***F21V 29/00*** | (2015.01) |
| ***F21V 29/71*** | (2015.01) |
| *F21V 29/60* | (2015.01) |
| *F21Y 101/00* | (2016.01) |

(52) U.S. Cl.

CPC ..... *F21V 29/71* (2015.01); *F21V 29/60* (2015.01); *F21Y 2101/00* (2013.01)

(58) Field of Classification Search

CPC ..... F21V 29/60; F21V 29/71; F28D 15/04; F28D 15/043; F28D 2015/0216; F28D 2021/0029; H01L 23/40

USPC ..... 362/373, 294; 165/80.2–80.4, 104.26

See application file for complete search history.

(56) References Cited

U.S. PATENT DOCUMENTS

2008/0055911 A1* 3/2008 Shen ..... F21K 9/00 362/294

2009/0040760 A1* 2/2009 Chen ..... F21V 29/004 362/249.01

2009/0175045 A1* 7/2009 Shen ..... F21K 9/00 362/373

2009/0268463 A1* 10/2009 Huang ..... F21K 9/00 362/249.02

(Continued)

FOREIGN PATENT DOCUMENTS

| | | |
|---|---|---|
| CN | 101644424 A | 2/2010 |
| CN | 101713530 A | 5/2010 |

(Continued)

OTHER PUBLICATIONS

The Office Action Dated May 18, 2016 of the Corresponding Taiwan Patent Application No. 103128899.

*Primary Examiner* — Laura Tso
*Assistant Examiner* — Naomi M Wolford
(74) *Attorney, Agent, or Firm* — Chun-Ming Shih; HDLS IPR Services

(57) ABSTRACT

An LED lamp heat dissipating structure includes a first cover, a second cover, a heat dissipating device, and an LED light source. The first cover and the second cover cover each other to form a hollow space. The heat dissipating device is disposed inside the first cover and the second cover. The LED light source is disposed below the second cover and is in heat-conducting contact with the heat dissipating device. The heat dissipating device further includes a plurality of cover heat pipes. Each of the cover heat pipes has a heated end and a cooled end. The heated end is connected at the heat conducting base. The cooled end extends along the first flange of the first cover and the second flange of the second cover, respectively, so as to be sandwiched between the first flange and the second flange.

10 Claims, 6 Drawing Sheets

(56) References Cited

U.S. PATENT DOCUMENTS

2010/0014299 A1* 1/2010 Qin ..... F21V 29/004 362/373
2010/0259934 A1* 10/2010 Liu ..... F21V 29/004 362/294
2012/0236575 A1* 9/2012 Tsao ..... F21S 8/02 362/373
2014/0043810 A1* 2/2014 Jo ..... F21V 13/04 362/235
2014/0078737 A1* 3/2014 Lin ..... F21V 29/2206 362/249.02

FOREIGN PATENT DOCUMENTS

TW 200942741 A 10/2009
TW M392314 U1 11/2010
TW M500859 U 5/2015

* cited by examiner

LED LAMP HEAT DISSIPATING STRUCTURE

BACKGROUND

1. Technical Field

The present invention relates to a lighting equipment and, in particular, to an LED lamp heat dissipating structure which can be used in a large lamp such as a street lamp.

2. Related Art

Since a light emitting diode (LED) has advantages such as high luminance, power-saving, and a long life span, it has been widely used in electronic devices or lamp lighting. In order to increase an illumination scope and luminance of the LED, usually plural LEDs are used to constitute an LED lamp set which has been used to replace a large lamp, of a conventional bulb and etc., which is for example a street lamp.

In order to use the LED as a lamp light source, a heat dissipation problem of the high power LEDs needs to be solved. In the heat dissipating structure of a conventional LED lamp, a heat conducting structure is hidden inside the lamp and the heat dissipation effect is achieved only by utilizing heat dissipating fins protruding out from a top surface of the lamp to contact outside ambient air. However, this design easily causes the heat generated by the LED light source to be accumulated inside the lamp, thus affecting the heat dissipation effect.

In view of the foregoing, the inventor of the present invention made the present invention to improve the above-mentioned issues which are objects the inventor of the present invention aims for.

BRIEF SUMMARY

It is an object of the present invention to provide an LED lamp heat dissipating structure, which utilizing plural heat pipes to respectively conduct the heat and, in particular, to conduct the heat to a cover of a lamp to make heat exchange between the interior heat and the cooler outside ambient air, thereby achieving a good heat dissipation effect.

Accordingly, the present invention provides an LED lamp heat dissipating structure comprising a first cover, a second cover, a heat dissipating device, and an LED light source. The first cover includes a first cover portion and a first flange, and the first flange is surroundingly disposed around a circumferential edge of the first cover portion. The second cover includes a second cover and a second flange, the second flange is surroundingly disposed around a circumferential edge of the second cover portion, and the second cover and the first cover cover each other to form a hollow space. The heat dissipating device is disposed inside the first cover and the second cover. The heat dissipating device includes one heat conducting base, at least one fin set, and a plurality of heat pipes, the plurality of heat pipes being connected between the heat conducting base and the fin set. The LED light source is disposed below the second cover and is in heat-conducting contact with the heat conducting base of the heat dissipating device. The heat dissipating device further includes a plurality of cover heat pipes. Each of the cover heat pipes has a heated end and a cooled end. The heated end is connected to the heat conducting base. The cooled end extends along the first flange of the first cover and the second flange of the second cover, respectively, so as to be sandwiched between the first flange and the second flange.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
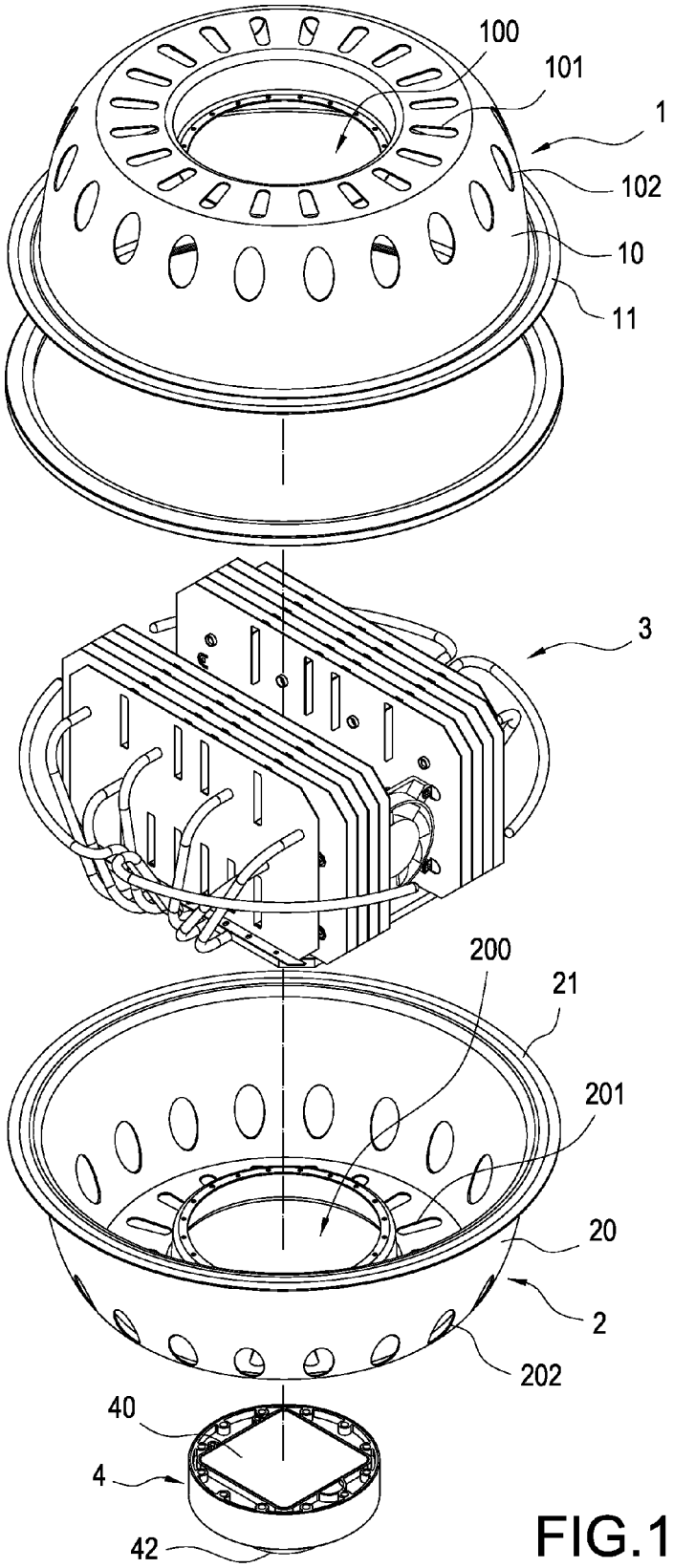
FIG. 1 is an exploded perspective view of the present invention.
Figure 2:
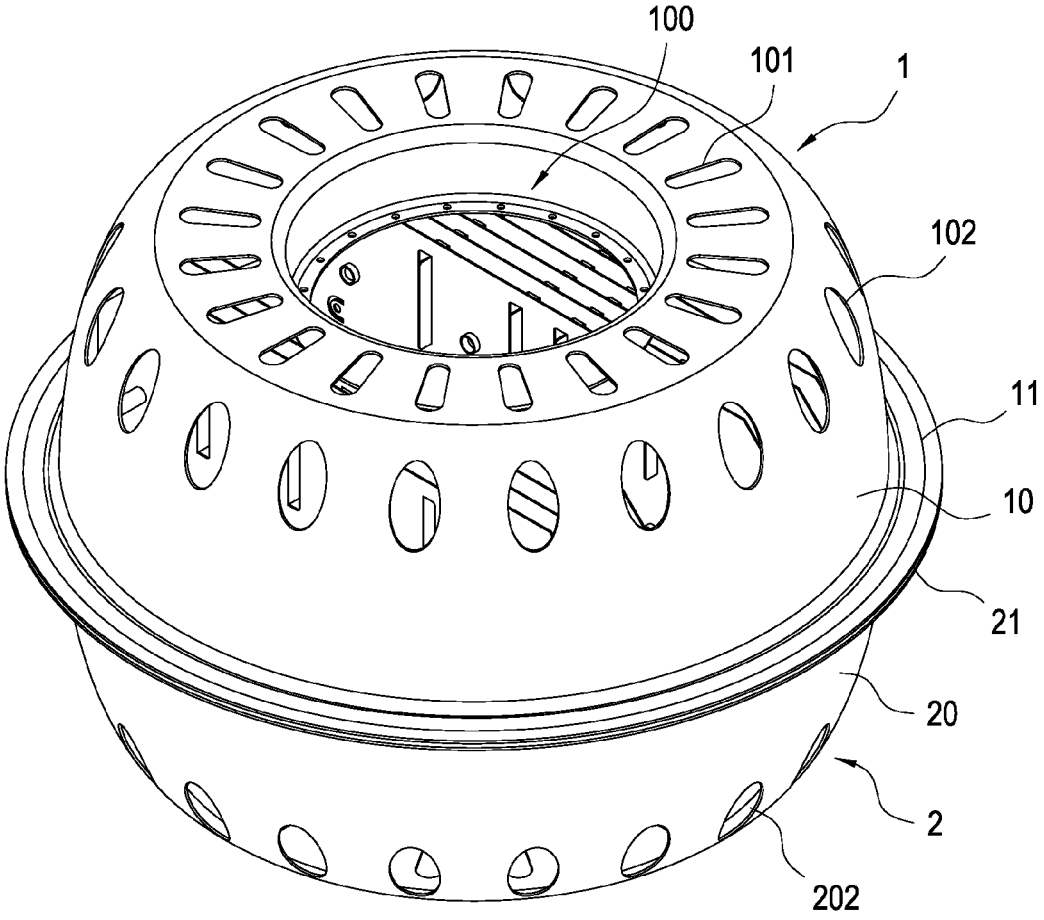
FIG. 2 is an assembled perspective view of the present invention.

Please refer to FIG. 1 and FIG. 2, respectively showing an exploded perspective view and an assembled perspective view of the present invention. The present invention provides an LED lamp heat dissipating structure which can be applied to large LED lamps such as a street lamp. The LED lamp heat dissipating structure comprises a first cover 1, a second cover 2, a heat dissipating device 3, and an LED light source 4. The first cover 1 and the second cover 2 cover each other to form a hollow space for accommodating the heat dissipating device 3 therein and for disposing the LED light source 4 below the second cover 2, and such that the LED light source 4 is in heat-conducting contact with the heat dissipating device 3 to dissipate the heat of the LED light source 4 by the heat dissipating device 3.

Figure 6:
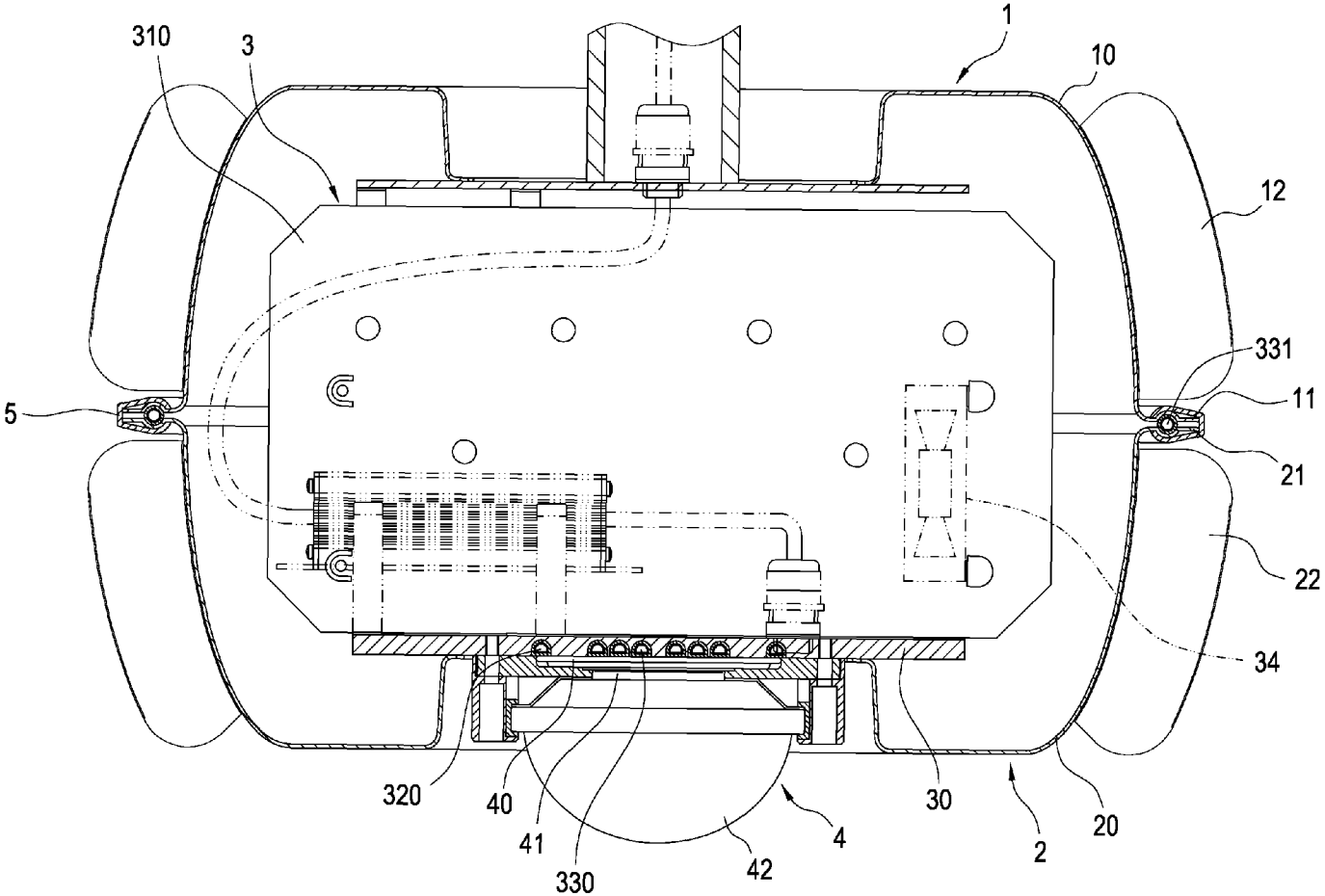
FIG. 6 is a schematic view of a use state of the present invention.

Furthermore, the first cover 1 includes a first cover portion 10 and a first flange 11, the first flange 11 being surroundingly disposed around a circumferential edge of the first cover portion 10. The second cover 2 includes a second cover portion 20 and a second flange 21, the second flange 21 being surroundingly disposed around the second cover portion 20. The first and second covers 1 and 2 cover each other by overlapping the first and second flanges 11 and 21, and such that the aforesaid heat dissipating device 3 can be disposed inside the first and second covers 1 and 2. Moreover, a first through hole 100 is formed on a top end of the first cover 1, and a second through hole 200 is formed on a bottom end of the second cover 2. The aforesaid LED light source 4 is assembled to the second through hole 200 and toward outside the second cover 2 (i.e., below the second cover 2, as shown in FIG. 6). Further, an electric wire of the LED light source 4 can extend, through the first through hole 100, to the outside to connect a power source (not illustrated).

Figure 3:
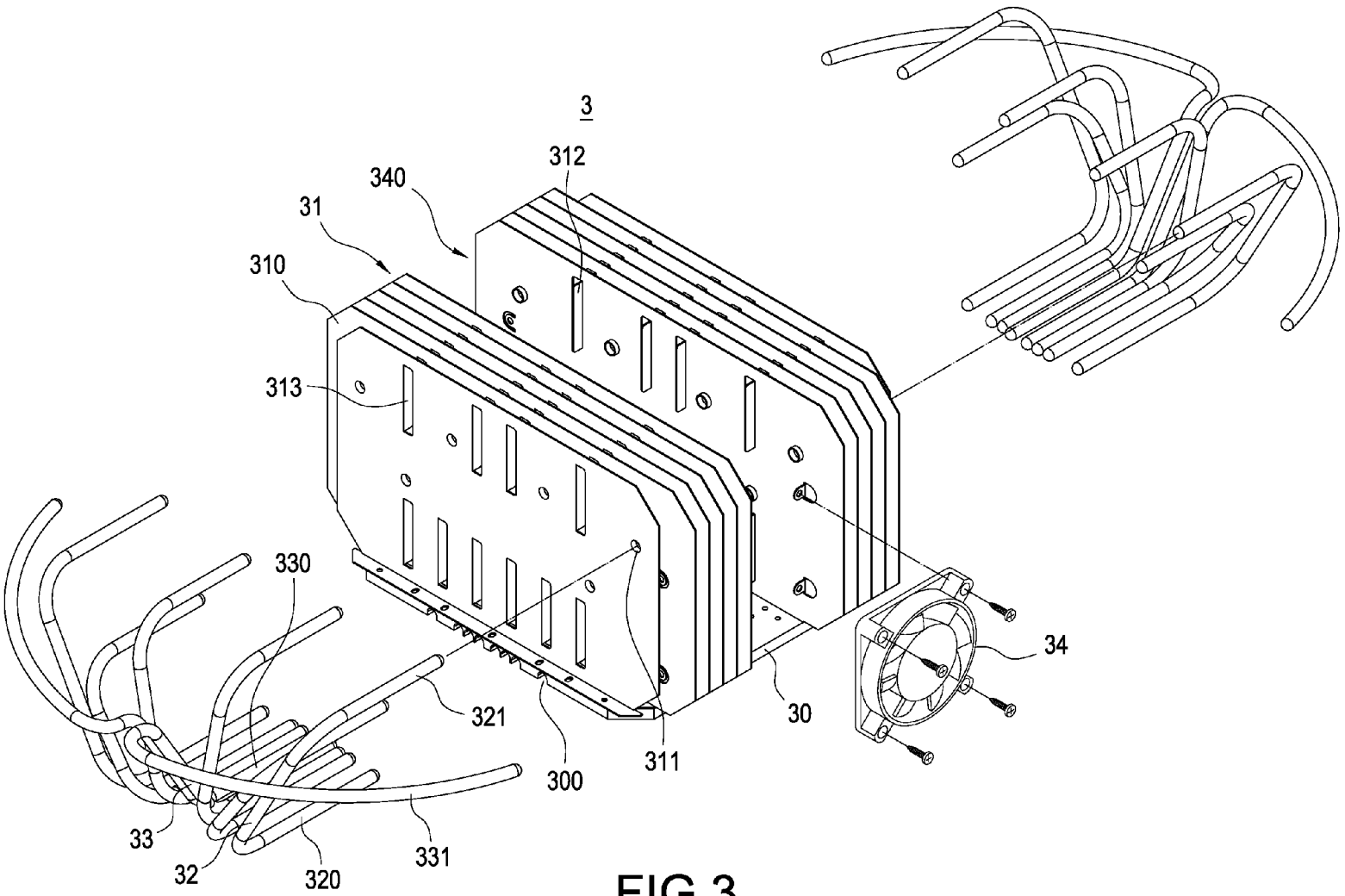
FIG. 3 is an exploded perspective view of a heat dissipating device according to the present invention.

Referring to FIG. 3, the heat dissipating device 3 includes a heat conducting base 30, at least one fin set 31, a plurality of heat pipes 32, and a plurality of cover heat pipes 33. A bottom surface of the heat conducting base 30 is in close contact with the LED light source 4 (as shown in FIG. 6). The LED light source 4 includes a circuit board 40, at least one LED chip 41 disposed on the circuit board 40, and a lens 42, wherein the lens 42 covers the LED chip 41 and is disposed outside the same, and the circuit board 40 overlaps and close contacts the heat conducting base 30 of the heat dissipating device 3, and such that the heat generated by the LED light source 4 can be conducted to the heat conducting base 30 to dissipate heat. A top surface of the heat conducting base 30 is in close contact with the fin set 31. The fin set 31 consists of a plurality of cooling fins 310 spaced apart from one another and is disposed over the heat conducting base 30. Each of the heat pipes 32 is connected between the heat conducting base 30 and the fin set 31. Each of the heat pipes 32 has a heated end 320 and a cooled end 321, the heated end 320 is connected at the heat conducting base 30, and the cooled end 321 is connected to the fin set 31. Specifically, a plurality of grooves 300 are disposed on the bottom surface of the heat conducting base 30 and corresponding the heat pipes 32 respectively, and so as to allow the heated end 320 passes through and connect. An opening 311 is disposed on each of the cooling fins 310 of the fin set 31 and corresponding to each of the heat pipes 32, so as to allow the cooled end 321 to pass through and connect.

Figure 4:
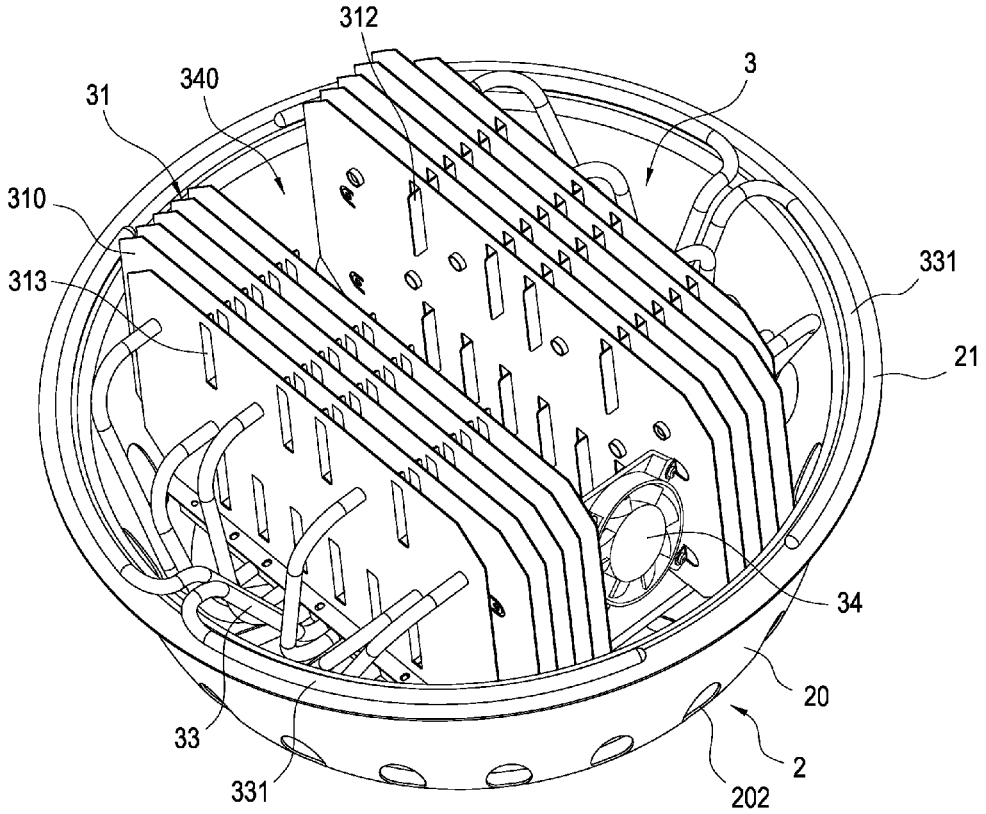
FIG. 4 is a perspective view illustrating an assembled state of the heat dissipating device and a second cover according to the present invention.

Please refer to FIGS. 3, 4 and 6. As above mentioned, the heat dissipating device 3 of the present invention includes each of the heat pipes 32 connected between the heat conducting base 30 and the fin set 31, and such that the heat conducting base 30 quickly dissipates the heat, generated by the LED light source 4, through the fin set 31. In addition to that, the heat dissipating device 3 utilized each of the cover heat pipes 33 to make heat dissipation, which is connected among the heat conducting base 30 and the first and second covers 1 and 2. Each of the cover heat pipes 33 also has a heated end 330 and a cooled end 331. The heated end 330 is connected at the heat conducting base 30. The cooled end 331 extends along the first flange 11 and the second flange 21, so as to be sandwiched between the first flange 11 of the first cover 1 and the second flange 21 of the second cover 2 (as shown in FIG. 6). More specifically, the heated end 330 of each cover heat pipe 33 passes through and is connected in the grooves 300 of the bottom surface of the heat conducting base 30. The cooled end 331 of each of the cover heat pipes 33 is sandwiched between the first flange 11 and the second flange 21 so as to cooperatively form an arc shape. The first flange 11 and the second flange 21 further include a fastening element 5 to enclose and clasp the first flange 11 and the second flange 21 thereoutside.

Furthermore, as shown in FIG. 3, in order to enhance the heat dissipation effect of the heat dissipating device 3 in the first and second covers 1 and 2 and to enhance convection of airflow therein, an airflow passage 340 is formed in-between each of the fin sets 31, and a fan 34 is disposed at one end of the airflow passage 340, and thereby the fan 34 provides airflow to generate convection, so as to prevent hot airflow accumulated in the fin set 31. At the same time, each of the cooling fins 310 can include a plurality of guiding fins 312 and a plurality of guiding holes 313 respectively corresponding to one another, so that airflow among each of the cooling fins 310 can communicate, and especially the guiding fins 312 can generate turbulent flow, thereby assisting in heat dissipation.

Figure 5:
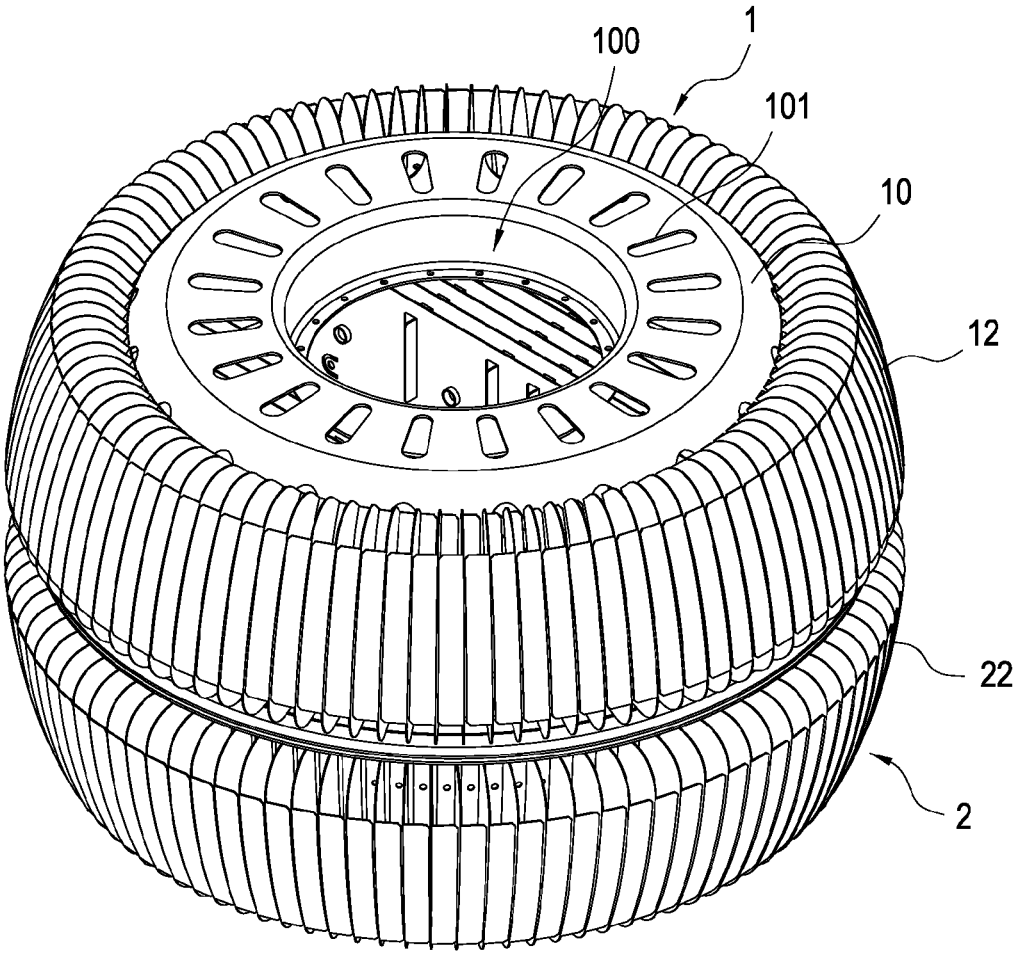
FIG. 5 is a perspective view of the appearance of the present invention, cooling fins being added thereon.

Moreover, as shown in FIGS. 1 and 2, in order to make the airflow in the first and second covers 1 and 2 communicate with the outside ambient air, a plurality of first longitudinal airflow holes 101 are disposed around a circumferential edge of the first through hole 100 of the first cover 1, a plurality of first lateral airflow holes 102 are disposed around the first cover portion 10, a plurality of second longitudinal airflow holes 201 are disposed around a circumferential edge of the second through hole 200 of the second cover 2, and a plurality of second lateral airflow holes 202 are disposed around the second cover portion 20. At the same time, as shown in FIG. 5, in order to enhance the heat dissipation effect of the first and second covers 1 and 2, a plurality of first outer fins 12 and a plurality of second outer fins 22 are disposed around outside the first cover portion 10 and the second cover portion 20 respectively to close contact the exterior of the first cover portion 10 and the second cover portion 20 respectively to increase a heat dissipation surface area.

Therefore, the above-mentioned structures can constitute the LED heat dissipating structure of the present invention.

Accordingly, as shown in FIG. 6, as mentioned above, the heat dissipating device 3 of the present invention utilizes each heat pipe 32 connected between the heat conducting base 30 and the fin set 31 to enable the heat conducting base 30 to quickly dissipate heat, generated by the LED light source 4, through the fin set 31. In addition to that, the heat dissipating device 3 utilizes each cover heat pipe 33 connected among the heat conducting base 30 and the first and second covers 1 and 2 , so that the first and second covers 1 and 2 assist in heat dissipation, and thereby the heat generated by the LED light source 4 can, instead of only being accumulated in each fin set 31 inside the first and second covers, be conducted onto the first and second covers 1 and 2 through each cover heat pipe 33 so as to enable heat exchange with the cooler outside ambient air and achieve good heat dissipation effect.

In summary, the present invention certainly can achieve the anticipated objects and improve the defects of conventional techniques, and has novelty and non-obviousness, so the present invention completely meet the requirements of patentability. Therefore, a request to patent the present invention is filed according to patent laws. Examination is kindly requested, and allowance of the present application is solicited to protect the rights of the inventor.

It is to be understood that the above descriptions are merely preferable embodiments of the present invention and not intended to limit the scope of the present invention. Equivalent changes and modifications made in the spirit of the present invention are regarded as falling within the scope of the present invention.

What is claimed is:

1. An LED lamp heat dissipating structure, comprising:

a first cover, including a first cover portion and a first flange, the first flange surroundingly disposed around a circumferential edge of the first cover portion;

a second cover, including a second cover portion and a second flange, the second flange surroundingly disposed around a circumferential edge of the second cover portion, the second cover and the first cover covering each other to form a hollow space;

a heat dissipating device disposed inside the first cover and the second cover, the heat dissipating device including a heat conducting base, at least one fin set, and a plurality of heat pipes connected between the heat conducting base and the fin set; and an LED light source, being disposed below the second cover and being in heat-conducting contact with the heat conducting base of the heat dissipating device, wherein the heat dissipating device further includes a plurality of cover heat pipes, each of the cover heat pipes has a heated end and a cooled end, the heated end is connected at the heat conducting base, and the cooled end extends along the first flange of the first cover and the second flange of the second cover, respectively, so as to be sandwiched between the first flange and the second flange.

2. The LED lamp heat dissipating structure of claim 1, wherein a first through hole is formed on a top end of the first cover, and a second through hole is formed on a bottom end of the second cover, and the LED light source is assembled to the second through hole and toward outside the second cover.

3. The LED lamp heat dissipating structure of claim 2, wherein a plurality of first longitudinal airflow holes are disposed around a circumferential edge of the first through hole of the first cover, a plurality of first lateral airflow holes are disposed around the first cover portion, a plurality of second longitudinal airflow holes are disposed around a circumferential edge of the second through hole of the second cover, and a plurality of second lateral airflow holes are disposed around the second cover portion.

4. The LED lamp heat dissipating structure of claim 1, wherein a plurality of first outer fins and a plurality of second outer fins are disposed around outside the first cover portion and the second cover portion respectively to close contact the exterior of the first cover portion and the second cover portion respectively.

5. The LED lamp heat dissipating structure of claim 1, wherein a top surface of the heat conducting base of the heat dissipating device is in close contact with the fin set.

6. The LED lamp heat dissipating structure of claim 1, wherein an airflow passage is formed in-between each of the fin sets of the heat dissipating device, and a fan is disposed at one end of the airflow passage.

7. The LED lamp heat dissipating structure of claim 1, wherein the fin set of the heat dissipating device consists of a plurality of cooling fins spaced apart from one another and is disposed over the heat conducting base.

8. The LED lamp heat dissipating structure of claim 7, wherein each of the cooling fins includes a plurality of guiding fins and a plurality of guiding holes respectively corresponding to one another.

9. The LED lamp heat dissipating structure of claim 1, wherein a plurality of grooves is disposed on a bottom surface of the heat conducting base of the heat dissipating device, the heated end of each of the cover heat pipes passes through and is connected in the grooves, and the cooled end of each of the cover heat pipes is sandwiched between the first flange and the second flange so as to cooperatively form an arc shape.

10. The LED lamp heat dissipating structure of claim 1, wherein the first flange and the second flange further include a fastening element to enclose and clasp the first flange and the second flange thereoutside.

* * * * *